US005332216A

United States Patent [19]

Whipple

[11] Patent Number: 5,332,216

[45] Date of Patent: Jul. 26, 1994

[54] TOY APPARATUS FOR CONSTRUCTING PATHWAY FOR MARBLE

[76] Inventor: Thomas D. Whipple, 5-9-16 Ogikubo, Apt. #402, Suginami-Ku, Tokyo, Japan

[21] Appl. No.: 51,370

[22] Filed: Apr. 23, 1993

[51] Int. Cl.[5] ..... A63F 7/00

[52] U.S. Cl. ..... 273/120 R; 273/109; 273/118 R

[58] Field of Search ..... 273/108, 109, 118 R, 273/119 R, 120 R, 440; 434/189

[56] References Cited

U.S. PATENT DOCUMENTS 3,655,191 4/1972 Grant ..... 273/108 X
3,825,265 7/1974 Pitkanen et al. ..... 273/121 B X
3,897,951 8/1975 Morrison et al. ..... 273/121 B X
4,055,344 10/1977 Soucie ..... 273/123 R X

*Primary Examiner*—Vincent Millin
*Assistant Examiner*—Raleigh W. Chiu
*Attorney, Agent, or Firm*—Tod R. Nissle

[57] ABSTRACT

A game has a plurality of directional elements which are attached to a vertical face in numerous arrangements to define paths along which a marble can travel. The game includes a plurality of housings which can be interconnected in a plurality of orientations with respect to one another such that openings in each pair of interconnected housings oppose and align with one another to permit the marble to travel from one housing to another through the opposing, aligned openings.

3 Claims, 3 Drawing Sheets

TOY APPARATUS FOR CONSTRUCTING PATHWAY FOR MARBLE

This invention relates to toys and games for amusement and for the improvement of dexterity and spatial reasoning abilities.

More particularly, the invention relates to games having a plurality of directional elements which can be attached to a vertical face in numerous arrangements to define paths along which an object can travel.

In a further respect, the invention relates to games having a plurality of housings which can be interconnected in a plurality of orientations with respect to one another such that openings in each pair of interconnected housing oppose and align with one another to permit an object to travel from one housing to another through the opposing, aligned openings.

Various toys are known which permit the construction of a pathway along which a marble or other movable object can travel. For example, U.S. Pat. No. 4,171,090 to Eisenburg defines a path comprised of a pair of parallel rails along which a marble rolls. In such toys, the marble is visible along its entire path of travel. In order to improve spatial reasoning abilities, providing apparatus which can be constructed so that an object moves from a first path of travel to a second path of travel by free falling through enclosed areas which must be aligned with one another requires a child or other user to visualize such free fall during assembly of the apparatus and the construction of the paths of travel. Such visualization broadens the imagination and spatial reasoning, particularly with respect to children. Children often visualize enclosed areas as equivalent to a "house" or "fort" and, consequently, play in closets or boxes as part of the process of developing reasoning and analytical skills. Children also are interested in marbles, balls, cars, and other freely movable objects which roll over the floor. Concealing items is another pastime in which children participate. Requiring children to visualize travel of a marble unseen through an enclosed area from one path of travel to another therefor is a process which children enjoy and is beneficial to development of their analytical thought processes.

Accordingly, it would be highly desirable to provide a toy which can be assembled and disassembled, which enables variable paths of travel for a movable object to be constructed, and which requires that openings in the toy be properly aligned so that the movable object free falls unseen through openings from a first path of travel to a second path travel.

Therefore, it is a principal object of the invention to provide an improved toy for constructing variable paths of travel for a movable object.

A further object of the invention is to provide an improved toy which permits construction of separate paths along which a movable object can travel and requires that openings in the toy be properly aligned so that the movable object can free fall from one path of travel to another path of travel.

Another object of the invention is to provide an improved toy which permits construction of a concealed path of travel for a movable object.

These and other, further and more specific objects and advantages of the invention will be apparent to those skilled in the art from the following detailed description thereof, taken in conjunction with the drawings, in which.

Briefly, in accordance with my invention, I provide an improved toy apparatus. The apparatus includes a panel having a vertically oriented face and a plurality of openings formed in the face; a plurality of directional elements each having at least one peripheral surface and at least one peg shaped and dimensioned to be inserted in at least one of the openings in the face. The pegs on the directional elements are inserted in the openings in the face of the vertically oriented panel during play to position the directional elements on the face such that various paths may be defined along the peripheral surfaces of the directional elements. Freely movable means is provided to travel along the paths defined by the peripheral surfaces.

In accordance with another embodiment of my invention, I provide a toy apparatus including a housing having a back having a vertically oriented face and at least one side attached to and extending outwardly from the vertically oriented face, and, at least one opening formed through the side. The apparatus also includes a plurality of directional elements each having at least one peripheral surface. Means are provided for removably attaching the directional elements to the vertically oriented face during play to position the directional elements on the face such that various paths may be defined by the peripheral surfaces of said directional elements. Means are also provided for traveling along the path defined by the peripheral surfaces.

In a further embodiment of my invention, I provide a toy apparatus comprising a plurality of housings each having a back having a vertically oriented face; at least one side attached to and extending outwardly from the vertically oriented face; and, at least one opening formed through the side. The apparatus also includes a plurality of directional elements each having at least one peripheral surface. Means are provided for attaching the directional elements to the vertically oriented face during play to position the directional elements on the face such that a path may be defined along the peripheral surfaces of the directional elements. Freely movable means is provided for traveling along the paths defined by the peripheral surfaces. The toy apparatus also includes means for removably connecting one of the housings to another of the housings such that the opening in one housing opposes the opening in the other housing and the freely movable means can travel from one of the housing through the opposing openings into the other of the housings.

Figure 1:
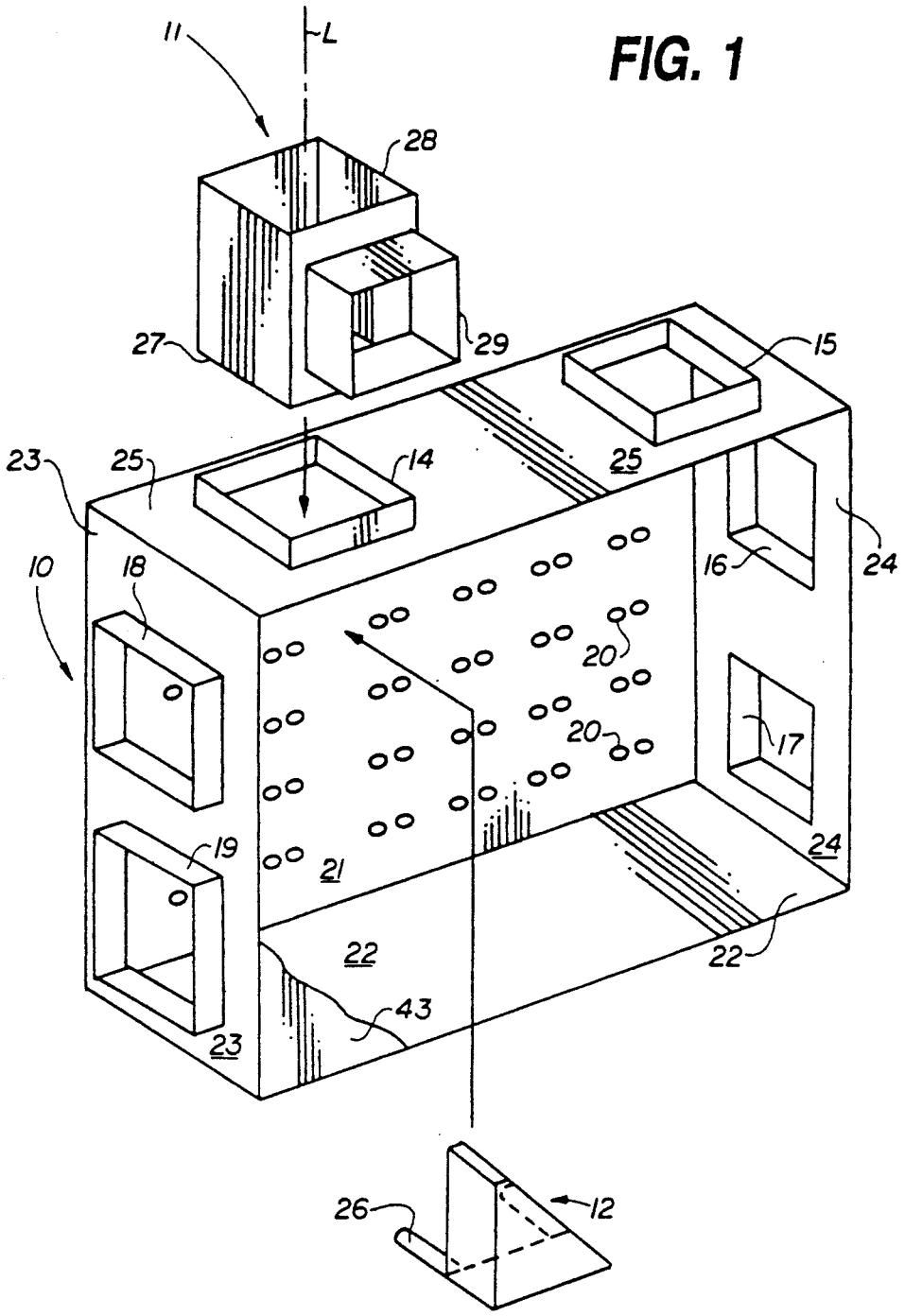
FIG. 1 is a perspective view illustrating a toy apparatus constructed in accordance with the principles of the invention.
Figure 2:
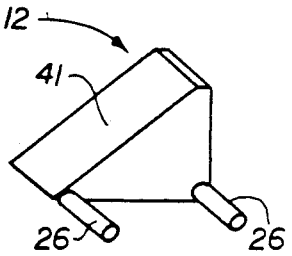
FIG. 2 is a perspective view illustrating a directional element used in the apparatus of FIG. 1.

Turning now to the drawings, which describe the presently preferred embodiments of the invention for the purpose of illustrating the practice thereof and not by way of limitation of the scope of the invention, and in which like reference characters refer to corresponding elements throughout the several views, FIGS. 1 to 4 illustrate toy apparatus constructed in accordance with the principles of the invention and including a housing 10 and a sleeve 11 used to interconnect a pair of adjacent housings 10 in the manner indicated in FIG. 2. In the drawings, it is assumed for sake of discussion that each housing 10 is identical. Housings 10 can, if desired, have different shapes and dimensions. Housing 10 includes vertically oriented back 21 provided with cylindrical apertures or openings 20 formed therein. Square lips 14, 15, 16, 17, 18, 19 circumscribe and extend outwardly from square openings formed in sides 23, 24, 25 of housing 10. Side 22 does not, but could have, square openings and corresponding outwardly projecting lips formed therein. Housing 10 can be provided with a removable rectangular cover 43 which has peripheral dimensions equivalent to those of back 21 and which encloses the area bounded by back 21 and sides 22 to 25. Openings 20 are shaped to slidably, removably, frictionally receive and seat pegs 26 on directional elements 9, 12, 13. Square lip 28 and square lip 27 of sleeve 11 each circumscribes central axis L. Square lip 29 outwardly projects from a square opening formed in sleeve 11. Lip 28 is shaped and dimensioned to slide over and frictionally engage a lip 14 to 19 in the same manner that lip 27 slides over lip 15 in FIG. 4. Lips 14 to 19 are of equal shape and dimension. Lips 27 to 29 are of equal shape and dimension.

Figure 3:
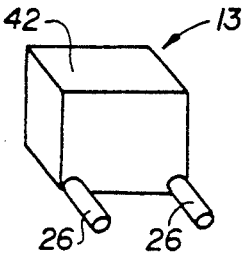
FIG. 3 is a perspective view illustrating another directional element used in the apparatus of FIG. 1.

In FIG. 2, directional element 12 includes inclined peripheral surface 41. In FIG. 3, directional element 13 includes peripheral surface 42. Each directional element can, if desired, be provided with guard rails which function to prevent a marble from rolling off of a peripheral surface of the directional element. For example, directional element 13 in FIG. 3 can be provided with guard rail 94.

Figure 4:
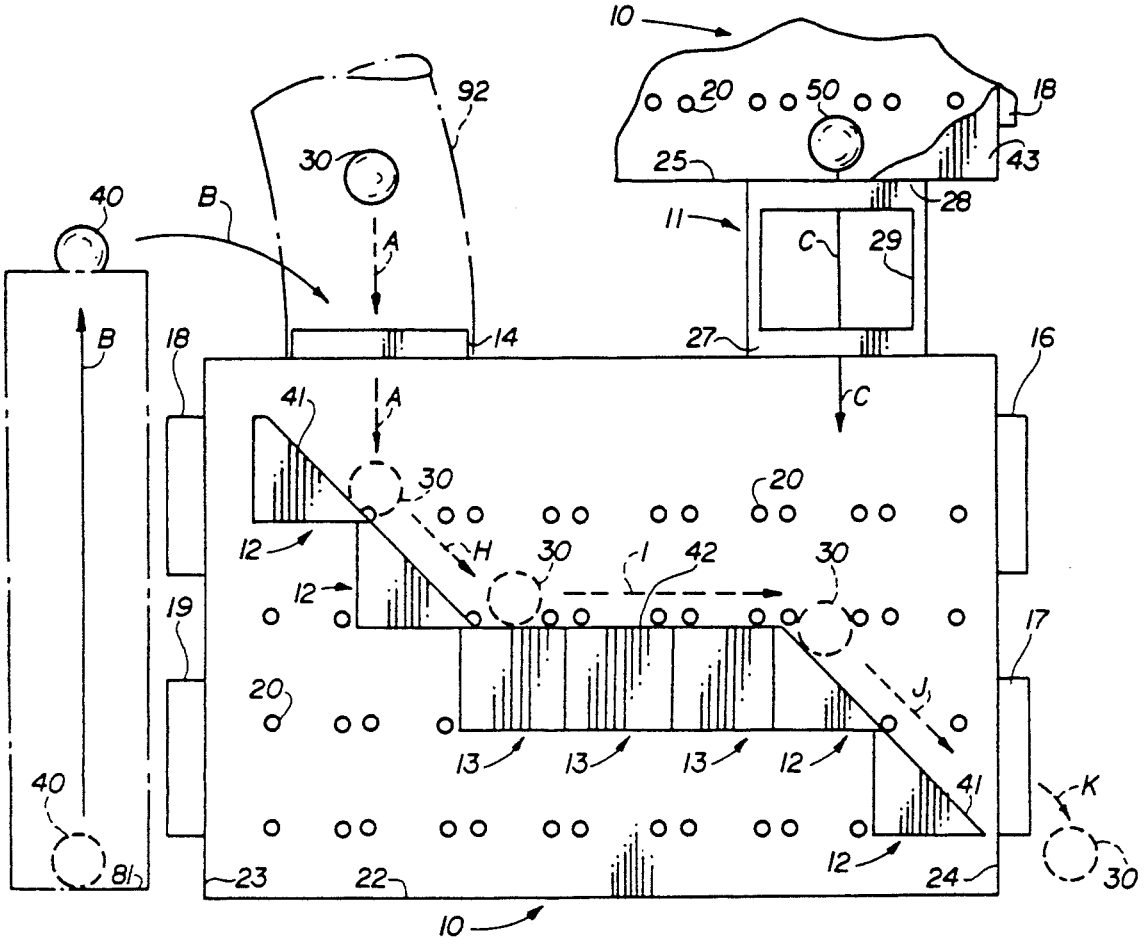
FIG. 4 is a front view illustrating the apparatus of FIG. 1 with concealed and visible paths of travel for a marble formed therein.

In FIG. 4, the pegs 26 on the backs of a plurality of directional elements 12 and 13 have been slidably inserted in openings 20 in back 21 for form a path of travel for a marble 30. When a marble 30 falls under gravity in the direction of arrow A, it contacts the inclined peripheral surfaces 41 of elements 12 in the direction of arrow H; rolls over the horizontally oriented peripheral surfaces 42 of directional elements 13 in the direction of arrow I; rolls over the inclined peripheral surface 41 of elements 12; and, rolls out through the opening circumscribed by lip 17 in the direction of arrow K. Mechanical or other means 81 can be utilized to lift marbles 40 from the ground in the direction of arrow B to a position at which the marbles can be released to fall under gravity through the square opening circumscribed by sleeve 14 or to fall through some other selected opening.

As shown in FIG. 4, a sleeve 11 is used to interconnect a pair of adjacent housings 10 and to align one square opening in one housing with a second square opening in the second housing. After a marble 50 passes along a pathway in the first (or upper) housing 10 in FIG. 4, the marble free falls, out-of-sight, through a square opening in the upper housing 10, through sleeve 11, and through a square opening in the lower housing 10 in the direction of arrow C onto the inclined surface 41 of a directional member 12. The pathway in the first (or upper) housing 10 in FIG. 4 is defined by peripheral surfaces on directional elements which are position in the upper housing 10 by pushing the peg(s) 26 on the housings into apertures 20. In FIG. 4, the upper housing 10 is, in comparison to the lower housing 10 pictured in FIG. 4, upside down. And, of course, only a portion of the upper housing 10 is illustrated in FIG. 4.

Figure 5:
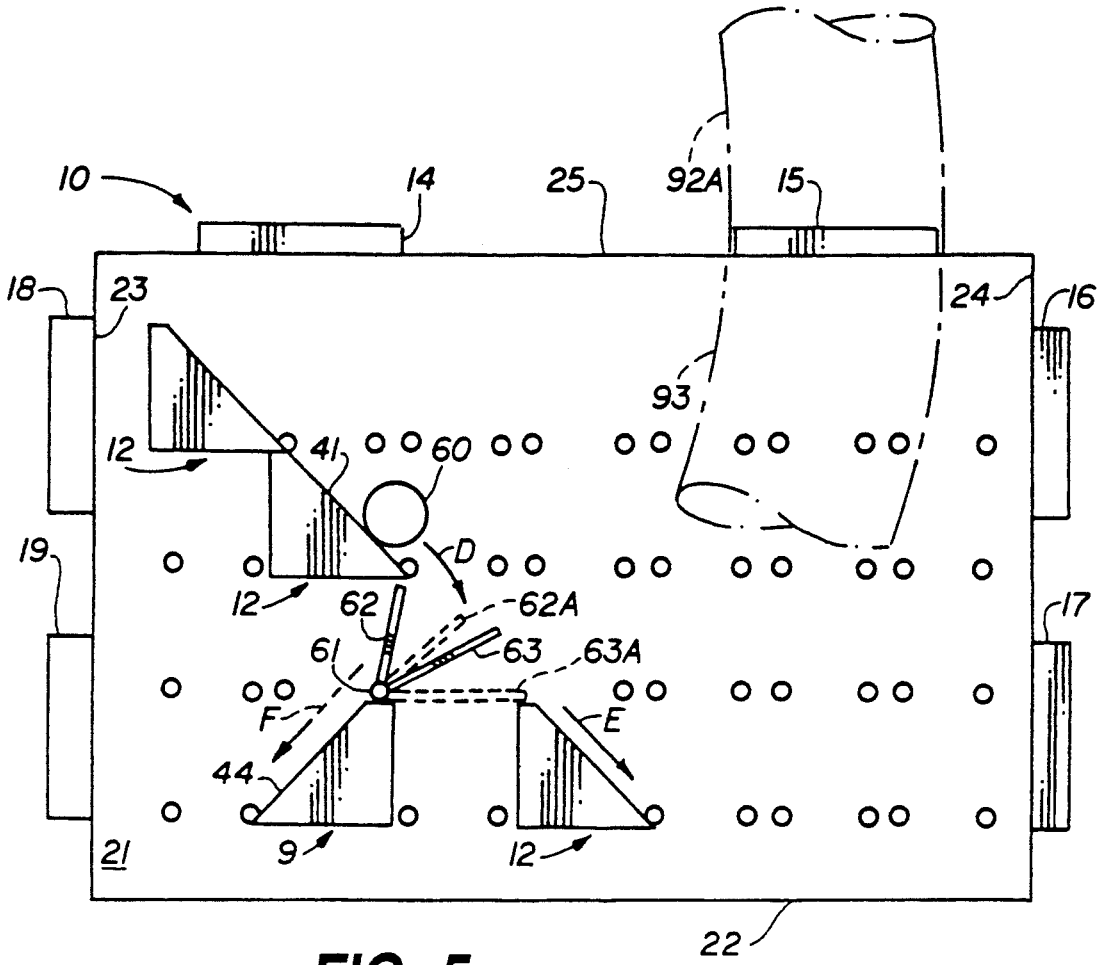
FIG. 5 is a front view illustrating the apparatus of FIG. 1 illustrating a switch which is activated by a marble traveling through the apparatus.

In FIG. 5, rectangular panel-shaped arms 62, 63 are fixedly attached to a cylindrical pin 61 which is slidably received by an opening 20 formed in back 21. A marble 60 rolling down incline 41 in the direction of arrow D under the force of gravity strikes arm 63, causing arms 62 and 63 and pin 61 to pivot downwardly clockwise to the position illustrated by dashed lines 62A and 63A. After arms 62 and 63 pivot to the position shown by dashed lines 62A and 63A, the marble continues to roll downwardly over incline 41 in the direction indicated by arrow E. The next marble which rolls down an incline 41 in the direction of arrow D contacts arm 62 (which is in the position illustrated by dashed lines 62A) and rolls down arm 62A over peripheral surface 44 of directional element 9 in the direction of travel indicated by arrow F. Consequently, the weight of marble 60 is used to activate and displace the switch comprised of arms 62 and 63 such that the path of travel defined by the switch and directional elements 9, 12 is altered when the marble contact the switch.

Figure 6:
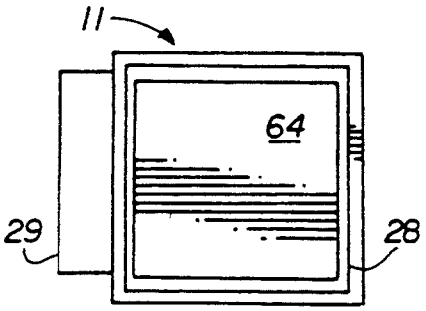
FIG. 6 is a top view illustrating a sleeve used to interconnect a pair of housing members such that a marble moves a concealed path of travel while moving from one housing member to the other housing member; and, FIG. 7 is a side elevation view further illustrating the sleeve of FIG. 6.
Figure 7:
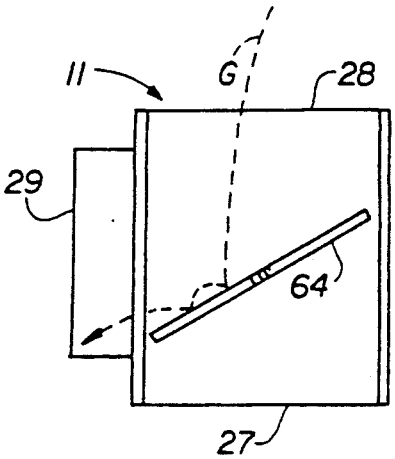

FIGS. 6 and 7 illustrate a square panel 64 which is preferably removably fixed in a sleeve 11 to deflect a marble free falling through sleeve 11 in the direction of arrow G so that the marble rolls or bounces through the square opening circumscribed by square lip 29.

Instead of using sleeves 11 to interconnect an adjacent pair of housings 10, the lips 14, 15 on one housing 10 can be shaped and dimensioned to slidably frictionally fit over the lips 18, 19 of another housing so that the lips 14, 15, 18, 19 can be slid over one another and used to interconnect a pair of housings and to align a square opening formed in the side 25 of one housing with a square opening formed in the side 23 of another housing.

Sleeve 11 can simply comprise a hollow four sided sleeve without lip 29 or the square opening which is circumscribed by lip 29. Each side of sleeve is solid and has no opening formed therethrough. Such a sleeve would completely hide from view and conceal a marble traveling through the sleeve.

As earlier noted, each housing 10 can take on any desired shape and dimension and, for example, one or more of lips 14 to 19 can have a cylindrical shape instead of the square shapes shown in FIGS. 1 and 4. If lips 14 to 19 are cylindrical, then sleeve 11 is cylindrical, which, when a cylindrical sleeve 11 is fit over a cylindrical lip 14 to 19, permits the lip and housing 10 to be pivoted with respect to the cylindrical sleeve and the other housing attached to the sleeve. Further, cylindrical sleeve 11 can comprise a hose. The hose can be pliable, be rigid, be an accordian hose, can be clear, can be opaque or translucent, can be any desired color, and can be any desired length. Such a hose 92, 92A normally would at one end slide over and be removably attached to a lip 14 to 19 on one housing (FIGS. 4, 5) and at the other end slide over and be removably attached to a lip 14 to 19 on a second housing such that the hose extended between and interconnected the two housings 10. One end of such a hose 93 (FIG. 5) can, however, slidably removably frictionally fit inside a lip 15 so that the other end of hose 93 extends into and at least partially through a housing 10. The other end of the hose can hang freely inside housing 10. Further, in FIG. 5, hose 93 can extend from lip 15 to another lip like lip 17 so a marble falling downwardly into lip 15 would travel through the hose and out of the housing 10 through lip 17. Instead of pegs 26 and openings 20, VELCRO, magnets or any other desired means can be used to removably attach directional elements 12, 13 to back 21.

Having described my invention in such terms as to enable those skilled in the art to understand and practice it, and having described the presently preferred embodiments thereof, I claim:

1. A toy apparatus comprising:

(a) a plurality of housings each having (i) a back having a vertically oriented face, (ii) at least one side attached to and extending outwardly from said vertically oriented face, and, (iii) at least one opening formed through said side;

(b) a plurality of directional elements each having at least one peripheral surface;

(c) means for attaching said directional elements to said vertically oriented face during play to position said directional elements on said face such that a path may be defined along said peripheral surfaces of said directional elements;

(d) freely movable means for traveling along said paths defined by said peripheral surfaces; and, (e) connecting means for removably connecting one of said housings to another of said housings such that said opening in one housing opposes said opening in the other housing and said freely movable means can travel from said one of said housings through said opposing openings into the other of said housings.

2. The toy apparatus of claim 1 wherein said means for removably connecting said housings permits at least one of said housings to be pivoted with respect to the other of said housings.

3. The toy apparatus of claim 1 wherein said connecting means comprises a hose.

* * * * *